US009300087B2

(12) United States Patent
Smith et al.

(10) Patent No.: US 9,300,087 B2
(45) Date of Patent: Mar. 29, 2016

(54) MOUNTABLE CABLE INTERFACE

(71) Applicant: Trane International Inc., Piscataway, NJ (US)

(72) Inventors: Christopher Blake Smith, Whitehouse, TX (US); Kit W. Klein, Tyler, TX (US)

(73) Assignee: TRANE INTERNATIONAL INC., Piscataway, NJ (US)

( * ) Notice: Subject to any disclaimer, the term of this patent is extended or adjusted under 35 U.S.C. 154(b) by 0 days.

(21) Appl. No.: 14/514,146

(22) Filed: Oct. 14, 2014

(65) Prior Publication Data

US 2015/0104970 A1 Apr. 16, 2015

Related U.S. Application Data

(60) Provisional application No. 61/890,737, filed on Oct. 14, 2013.

(51) Int. Cl.

| | |
|---|---|
| ***H01R 13/62*** | (2006.01) |
| ***H01R 13/639*** | (2006.01) |
| ***H01R 13/627*** | (2006.01) |
| *H01R 24/64* | (2011.01) |

(52) U.S. Cl.

CPC ..... *H01R 13/6395* (2013.01); *H01R 13/6275* (2013.01); *H01R 24/64* (2013.01)

(58) Field of Classification Search

CPC ..... H01R 13/6395; H01R 13/6275; H01R 24/64; H01R 23/025

USPC ..... 439/373, 344, 350–354, 676, 536

See application file for complete search history.

(56) References Cited

U.S. PATENT DOCUMENTS

| | | | | |
|---|---|---|---|---|
| 6,031,909 | A | 2/2000 | Daoud | |
| 7,438,584 | B2 * | 10/2008 | Caveney | H01R 13/6397 439/344 |
| 2007/0270016 | A1 * | 11/2007 | Boyd | H01R 13/6272 439/354 |
| 2008/0090433 | A1 | 4/2008 | Murano et al. | |
| 2010/0136809 | A1 | 6/2010 | Andres et al. | |

OTHER PUBLICATIONS

International Search Report and Written Opinion in corresponding PCT Application (i.e., PCT/US14/60514), mailed Jan. 22, 2015 (7 pages).

* cited by examiner

*Primary Examiner* — Amy Cohen Johnson
*Assistant Examiner* — Milagros Jeancharles
(74) *Attorney, Agent, or Firm* — Taft Stettinius & Hollister LLP

(57) ABSTRACT

A mounting plate assembly for securing a plug of a network cable to a jack of an electronic device. The assembly includes a mounting plate having an attachment mechanism that is configured for releasable locking engagement with the electronic device. Further, the mounting plate is adapted to be mounted to a mounting structure. The mounting plate includes inner passageway that is adapted to receive insertion of at least a portion of the plug. Additionally, the inner passageway is adapted to depress a locking clip of the inserted plug to a position that prevents the locking clip from lockingly engaging a protrusion in an aperture of the jack. Further, the retention member may include at least one arm that is configured to retain the plug in a relatively static position relative to the mounting plate when the plug is being received in, and removed from, the aperture of the jack.

21 Claims, 6 Drawing Sheets

MOUNTABLE CABLE INTERFACE

CROSS REFERENCE TO RELATED APPLICATIONS

The present application claims the benefit of U.S. Provisional Patent Application Ser. No. 61/890,737, filed Oct. 14, 2013, which is incorporated herein by reference in its entirety.

BACKGROUND

Embodiments of the present invention generally relate to an interface between an electronic network cable and a removable electronic device. More particularly, but not exclusively, embodiments of the present invention relate to an interface between a wall-mounted Ethernet cable and a detachable electronic thermostat.

Various types of electronic devices have traditionally had a hard wired connection to other components within a system. For example, controller devices, including thermostats, among others, have traditionally had a direct or indirect hard wired connection(s) with the other components of a system, such as components a heating, ventilation, and air conditioning (HVAC) system, which is used to control the flow of electrical power to those components. Moreover, in general terms, operation of such controller devices may control the flow of electrical power to other components of the system based on the satisfaction or/and occurrence of certain conditions or events. For example, with respect to certain thermostats, when the thermostat detects or is provided with information relating to an air temperature that is outside a certain pre-set level, the thermostat may operate to close a circuit, which may facilitate the delivery of electrical power to operate a furnace or an air conditioner.

However, contemporary control devices are more often being incorporated into, or operated as part of a network system. For example, electric thermostats may be operably connected to components of the HVAC system via one or more network or communication cables, such as, for example, an Ethernet cable, among other types of network or communication cables. According to certain types of systems, a network cable that is coupled to the electric thermostat may both be used to deliver power to the electric thermostat, as well as be used, at least in part, in the delivery of a signal or command that is communicated to or from the electric thermostat.

In at least certain situations, the network cable may include a plug that is received in a jack of the electronic device. Further, the plug may include a retaining or locking clip that lockingly engages the jack so as to operably retain the plug within the jack. To remove the plug from the jack, the user typically is required to depress the locking clip so as to disengage the locking clip from the locking engagement with the jack, and then displaced the plug relative to the jack, or vice versa. Further, the failure to detach the locking engagement between the locking clip and the plug when the electronic device is moved away from the cable can, in at least certain circumstances, damage the electronic device, including the jack, and/or damage the cable, including the plug.

BRIEF SUMMARY

An aspect of the present invention is a mounting plate for securing a plug of a network cable to a jack of an electronic device. The mounting plate includes an inner wall that generally defines an inner passageway, the inner passageway being configured to receive placement of at least a portion of the plug of the network cable. The inner wall is sized to engage a locking clip of the plug when the plug is operably positioned in the inner passageway to displace the locking clip to a position that prevents the locking clip from lockingly engaging a mating protrusion in the aperture of the jack. Additionally, according to certain embodiments, the mounting plate includes at least one arm that is configured to retain the plug in a relatively static position relative to the mounting plate when the plug is being received in, and removed from, an aperture of the jack.

Another aspect of the present invention is a mounting plate assembly for securing a plug of a network cable to a jack of an electronic device. The mounting plate assembly includes a mounting plate having an attachment mechanism that is configured for releasable locking engagement with the electronic device. Further, the mounting plate is adapted to be mounted to a mounting structure by one or more fasteners. The mounting plate assembly also includes a retention member that is adapted for slideable displacement from a first, unlocked position to a second, locked position in an opening of the mounting plate. The retention member also includes an inner wall that extends between a front portion and a rear portion of the mounting plate. The inner wall may define an inner passageway that is adapted to receive insertion of at least a portion of the plug. Additionally, the inner wall is adapted to depress a locking clip of the inserted plug to a position that prevents the locking clip from lockingly engaging a mating protrusion in an aperture of the jack. Further, the retention member may include at least one arm that protrudes from the rear portion of the retention member that is configured to retain the plug in a relatively static position relative to the retention member when the plug is being received in, and removed from, the aperture of the jack.

Another aspect of the present invention is a wall-mounted assembly that interfaces with a plug of a network cable. The wall-mounted assembly includes an electronic device having a jack that has an aperture that is adapted to receive insertion of at least a portion of the plug. The aperture also includes a protrusion that is configured to lockingly engage a locking clip of the plug. The wall-mounted assembly also includes a mounting plate that is adapted to be attached to a wall by one or more fasteners. The mounting plate may include an inner passageway that is size to receive placement of at least a portion of the plug of the network cable. The inner passageway may also be configured to displace the locking clip to a depressed position to prevent the locking clip from lockingly engaging the protrusion of the jack when the plug is operably positioned within the aperture. The mounting plate may further include at least one arm that is configured to retain the plug in a relatively static position relative to the mounting plate when the plug is being received in, and removed from, the aperture of the jack.

Another aspect of the present invention is a wall-mounted assembly that includes an electronic device and a mounting plate that is configured to detachably secure the electronic device to a wall. The electronic device includes a jack configured for connection with a cable plug having a locking clip. According to certain embodiments, the mounting plate includes a retention member configured to prevent the cable, and more specifically, a plug of the cable, from being removed from the jack. The mounting plate and the jack are configured such that the electronic device can be removed from the mounting plate without disengaging the locking clip on the plug. Further embodiments, forms, features, aspects, benefits, and advantages of the present application shall become apparent from the description and figures provided herewith.

Figure 1:
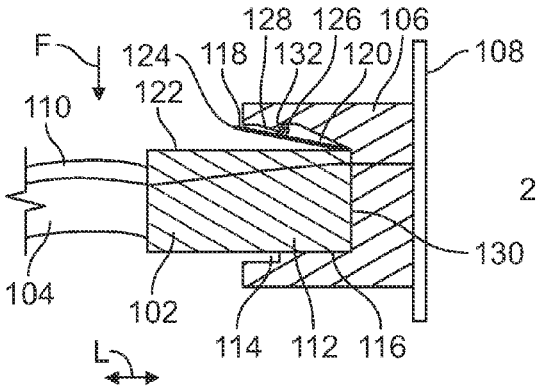
FIG. 1 (Prior Art)
FIG. 1 illustrates a cross sectional side view of a conventional locking engagement between a plug of an Ethernet cable and a corresponding jack of an electronic device.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings. Further, like reference numbers refer to lick parts throughout the several views.

DESCRIPTION OF THE ILLUSTRATED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. Further, certain terminology is used in the foregoing description for convenience and is not intended to be limiting. Words such as "upper," "lower," "top," "bottom," "downward," "inwardly," "first," and "second" designate directions in the drawings to which reference is made. This terminology includes the words specifically noted above, derivatives thereof, and words of similar import. Additionally, the words "a" and "one" are defined as including one or more of the referenced item unless specifically noted.

FIG. 1 illustrates a cross sectional side view of a conventional locking engagement between a plug 102 of an Ethernet cable 104 and a corresponding jack 106 of an electronic device 108. The cable 104 may include one or more cable wires 110 that may transmit a variety of electronic signals and/or power along the cable 104 and to components of the associated networked system. The plug 102 includes a plug body 112 that is received in an aperture 114 of the jack 106. The aperture 114 of the jack 106 may be generally defined by an inner wall 116 of the jack 106 that is generally shaped to conform to at least the front or face portion of the plug 102. Further, according to certain embodiments, the aperture 114 may be generally configured so as to allow the plug 102 to be operably positioned within the jack 106, such that one or more electric contacts of the plug 102 that are operably connected to the one or more cable wires 110 of the cable 104 may be in electrical communication with corresponding leads of the jack 106.

The plug 102 also includes a locking clip 118 that is adapted to lockingly secure the plug 102 within the aperture 114 of the jack 106. The locking clip 118 includes an arm portion 120 that is operably connected to an outer surface 122 of the plug body 112 such that the arm portion 120 may be deflected, bent, and/or deformed relative to the plug body 112. For example, when a downward force (as indicated by "F" in FIG. 1) is operably exerted against the arm portion 120, the arm portion 120 at and/or in proximity to the union between the arm portion 120 and the plug body 112 may be bent, deformed, and/or deflected such that a distal end 124 of the arm portion 120 is generally displaced toward an adjacent outer surface 122 of the plug body 112. Moreover, according to certain plug 102 configurations, such a force may displace the arm portion 120 from a first, rest position to a second, depressed position and thereby decrease the distance between at least a portion of the of the arm portion 120 and the adjacent outer surface 122 of the plug body 112.

The arm portion 120 may also include an outwardly extending tab portion 126 that is adapted to engage a mating inwardly extending protrusion 128 in the aperture 114 of the jack 106 so as to facilitate a locking engagement between the plug 102 and the jack 106. Moreover, the protrusion 128 may inwardly extend from an inner wall 116 of the jack 106. When the plug 102 is to be inserted into the aperture 114 of the jack 106, a user may downwardly depress the locking clip 118 so as displace the arm portion 120 from the first, rest position to the second, depressed position. Such depression of the arm portion 120 may also displace the tab portion 126 toward the plug body 112. Alternatively, rather than the user displacing the arm portion 120, the arm portion 120 and/or the tab portion 126 of the locking clip 118 may engage at least a portion of the inner wall 116 of the jack 106, including the protrusion 128, as the plug 102 is being received into the aperture 114 of the jack 106. Such an engagement may also cause the locking clip 118 to be displaced from the first, rest position, and toward the second, depressed position.

The protrusion 128 may be laterally positioned ("L" direction in FIG. 1) along the inner wall 116 of the jack 106 such that, when the plug 102 is operably positioned in the aperture 114 of the jack 106 so that at least some of the electrical contacts of the plug 102 are in electrical communication with corresponding leads of the jack 106, the arm portion 120 may be released back to and/or generally towards the first, rest position. Moreover, when the plug 102 is operably positioned within the jack 106, the tab portion 126 of the locking clip 118 may be positioned between an end wall 130 of the jack 106 and an abutment surface 132 of the protrusion 128. Such positioning of the tab portion 126 relative to the protrusion 128 may generally prevent the plug 102 from being removed from the aperture 114 of the jack 106. Moreover, the abutment surface 132 of the protrusion 128 may provide a barrier or other interference that generally prevents the plug 102 from being withdrawn from the aperture 114 of the jack 106 (without at least potentially damaging to the plug 102 or jack 106) unless the arm portion 120 has been displaced toward the plug body 112. Thus, in the event the plug 102 is to be withdrawn from the aperture 114 of the jack 106, the arm portion 120 may be depressed toward the second, depressed position, thereby displacing the tab portion 126 to a position in which the tab portion 126 does not, and will not, engage the abutment surface 132 in a manner that would resist or otherwise prevent removal of the plug 102 from the aperture 114 of the jack 106.

Figure 2:
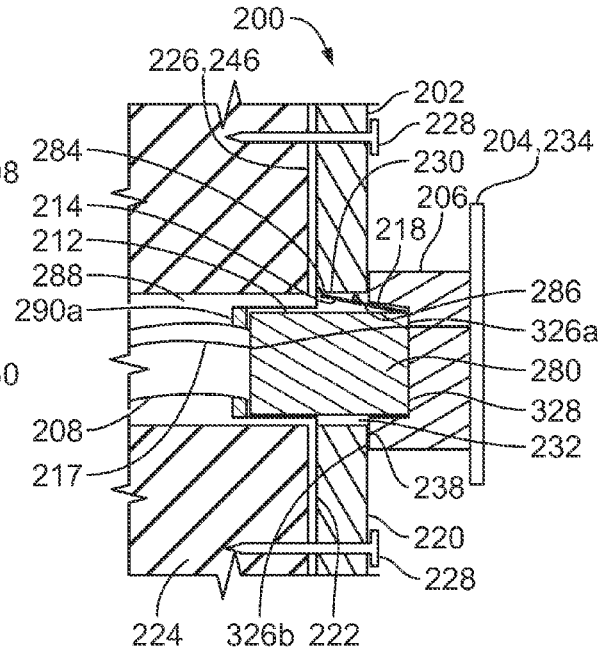
FIG. 2 illustrates a cross sectional side view of a wall-mounted assembly according to an embodiment of the present invention.

FIG. 2 illustrates a cross sectional side view of a wall-mounted assembly 200 according to an embodiment of the present invention. The wall-mounted assembly 200 includes a mounting plate 202, an electronic device 204 having a jack 206, and a network cable 208 having a plug 212. As discussed below in more detail, the wall-mounted assembly 200 is adapted for the plug 212 to be operably received in the aperture 218 of the jack 206 without the locking clip 214 lockingly engaging the mating protrusion 216 of the jack 206. The cable 208 may be selected from a variety of different types of networking or communication cables, including, for example, Ethernet cables. Further, the cable 208 may be adapted to deliver communications and/or electrical power to/from the electronic device 204. The plug 212 may also have a variety of different configurations so as to be adapted for use with different styles of jacks 206 and/or different network communication protocols. For example, according to the illustrated embodiment, the plug 212 may be an eight position, eight contact (8P8C) plug 212 that is adapted to connect the one or more cable wires 217 to the corresponding leads of the jack 206. Moreover, the configuration of the leads of the jack 206 may correspond to the configuration of the cable wires 217.

The mounting plate 202 may include opposing first and second sides 220, 222. According to certain embodiments, at least the first side 220 of the mounting plate 202 may include features, such as, for example, protrusions or recesses, among other features, that are configured to at least assist in allowing the electronic device 204 to be removably secured to the mounting plate 202. Further, according to certain embodiments, in addition to securing the electronic device 204 to the mounting structure 224, the mounting plate 202 may also be configured to house at least a portion of the electronic device 204. Additionally, according to certain embodiments, at least a portion of the second side 222 may be configured to be mounted to, or otherwise securely positioned against, an adjacent mounting structure 224, such as, for example, a wall, bracket, housing, cabinet, or other electronic device, among other mounting structures 224. Moreover, the mounting plate 202 may be adapted to be coupled to the mounting structure 224 with at least a portion of the second side 222 abutting a mounting surface 226 of the mounting structure 224, by one or more fasteners 228, such as, for example, by one or more screws, bolts, nails, pins, and/or adhesives, among other fasteners 228. For example, according to the embodiments depicted in FIGS. 2 and 3, the mounting plate 202 is operably secured with at least a portion of the second side 222 abutting against the mounting surface 226 of the mounting structure 224 via at least two fasteners 228, such as, for example, nails and/or screws.

Additionally, according to certain embodiments, the mounting plate 202 includes an inner wall 230 that generally defines an inner passageway 232 through the mounting plate 202. Referencing FIGS. 2 and 3, according to certain embodiments, the inner wall 230, and thus the inner passageway 232, may generally extend between the first and second sides 220, 222 of the mounting plate 202. Additionally, the inner passageway 232 may be sized to receive at least a portion of the plug 212 and/or the cable 210. Additionally, as discussed below in more detail below, the inner passageway 232 may be part of a retention member 256 that is part of, or operably connected to, the mounting plate 202.

The electronic device 204 is configured to receive and transmit signals via the cable 210 through, at least in part, the operable engagement between the plug 212 and the jack 206. A variety of different types of electronic devices 204 may be employed. For example, referencing FIG. 4, according to the illustrated embodiment, the electronic device 204 is a controller, such as, for example, an electronic thermostat 234, which may include a printed circuit board (PCB), microprocessors, and/or other computing devices. According to certain embodiments, the electronic thermostat 234 is configured to control the operation of an HVAC system by providing or exchanging signals to/with components of the HVAC system using, at least in part, one or more of the cables 208. Communications or signals received by the electronic thermostat 234 may include, for example, data relating to a user preference relating to operation of the HVAC system or an air temperature, while communications sent by the electronic thermostat 234 may include commands to which the HVAC system is responsive, and may or may not be based on calculations performed by the electronic thermostat 234. Further, a variety of different jacks may be used for the jack 206 of the electronic device 204. For example, according to certain embodiments, the jack 206 is a RJ45 jack that has leads that are configured to transmit signals between the cable wires 217 and the electronic device 204.

Figure 4:
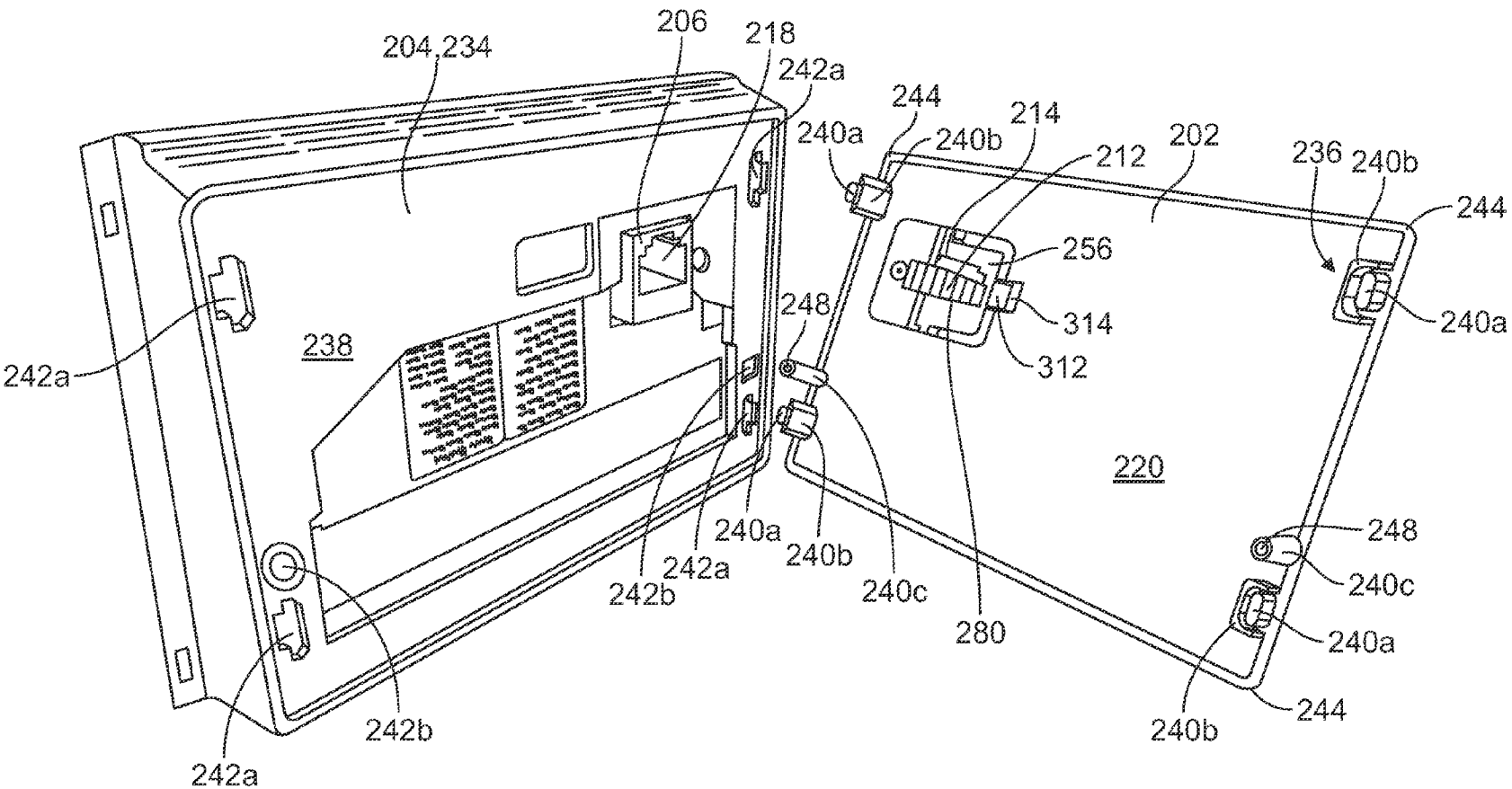
FIG. 4 illustrates a rear side perspective view illustrating of an electronic device that is an electronic thermostat and a first side of a mounting plate according to an embodiment of the present invention.

According to certain embodiments, the mounting plate 202 and/or the electronic device 204 includes one or more attachment mechanisms 236, such as, for example, clips, posts, tabs, protrusions, apertures, recess, pins, or mechanical fasteners, among other attachment mechanisms, that at least assist in removably securing or locking the mounting plate 202 to the electronic device 204. For example, FIG. 4, is a perspective view illustrating a rear side 238 of an electronic device 204 that is an electronic thermostat 234 and the first side 220 of a mounting plate 202 according to an embodiment of the present invention. According to the illustrated embodiment, the attachment mechanism(s) 236 of the mounting plate 202 includes one or more protrusions 240*a-c* that extend at least from the first side 220 of the mounting plate 202 that are to be received in mating orifices 242*a*, 242*b* of the electronic thermostat 234. Alternatively, according to other embodiments, at least some of the protrusions 240*a-c* may extend from the rear side 238 of the electronic thermostat 234 and at least some of the mating orifices 242 may be positioned at least on the first side 220 of the mounting plate 202.

Figure 5:
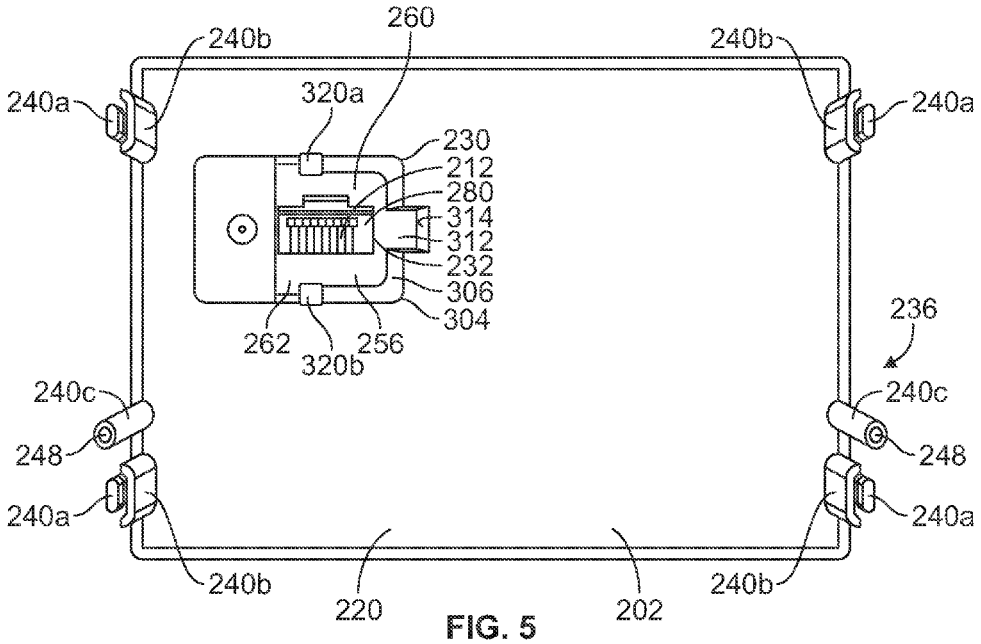
FIG. 5 illustrates a front view of a mounting plate according to an embodiment of the present invention.

Referencing FIGS. 4 and 5, according to the depicted embodiments, at least a portion of the one or more protrusions 240*a*, 240*b* may provide one or more tabs or clips that are to be received in one or more mating orifices 242*a* on the rear side 238 of the electronic thermostat 234, or vice versa. Moreover, such protrusions 240*a*, 240*b* and/or orifices 242*a* may be configured such that at least a portion of one or more of the protrusions 240*a*, 240*b* are bent, deflected, and/or deformed when received in the mating orifice 242*a* so as to provide a force between the engagement of the protrusions 240*a*, 240*b* and the mating orifices 242*a* that securely retains the protrusions 240*a*, 240*b* in the orifices 242*a*. For example, in the depicted embodiment, a protrusion 240*b* positioned in proximity to each corner 244 of the mounting plate 202 may be adapted to be bent, deflected, and/or deformed toward another adjacent protrusion 240*a* when the protrusions 240*a*, 240*b* are received in the mating orifices 242*a*. Such displacement of at least a portion of one or more of the protrusions 20*a*, 240*b* may result in a pressing engagement between the protrusions 240*a*, 240*b* and the corresponding orifice 242*a* that retains the protrusions 240*a*, 240*b* in the orifice 240*a*, thereby relatively securely coupling the electronic thermostat 234 to the mounting plate 202. Additionally, according to other embodiments, one or more of the protrusions 240*b* may include a leg or extension that may be positioned against an inner surface of the rear side 234 of the electronic thermostat 234 so as to lockingly couple the electronic thermostat 234 to the mounting plate 202. Further, according to certain embodiments, the electronic thermostat 234 may be removed from engagement with the mounting plate 202 by the electronic thermostat 234 being displaced generally in the same direction as the protrusions 240*a*, 240*b* extend away from the first side 220 of the mounting plate 202. Alternatively, according to other embodiments, when the electronic thermostat 234 is to be displaced from the mounting plate 202, the user may directly or indirectly depress one or more of the protrusions 240*a*, 240*b* so as to displace or release at least a portion of one or more of the protrusions 240*a*, 240*b* from engagement with the thermostat 234 in a manner that allows the thermostat 234 to be displaced away from the mounting plate 202.

According to the illustrated embodiment, at least a portion of the protrusions 240*c* of the mounting plate 202 may include one or more posts that are also received in mating orifices 242*b* of the electronic thermostat 234. Such protrusions 240*c* may be at least configured to properly align other protrusions 240*a*, 240*b* of the mounting plate 202 with corresponding orifices 242*a* of the electronic thermostat 234. Further, such protrusions 240*c* may also be configured to extend into at least a portion of the electronic thermostat 234 to provide support to electronic thermostat 234 so as to at least assist in retaining the electronic thermostat 234 in a secure engagement with the mounting plate 202. For example, according to certain embodiments, at least a portion of the protrusions 240*c* may be configured to at least assist in retaining the electronic thermostat 234 in a vertical position when the mounting plate 202 is operably secured to a vertical wall 246. Additionally, according to certain embodiments, such protrusions 240*c* may also include an inner recess 248 that is configured to at least receive insertion of one or more of the fasteners 228 that secure the mounting plate 202 to the mounting structure 224.

Figure 6:
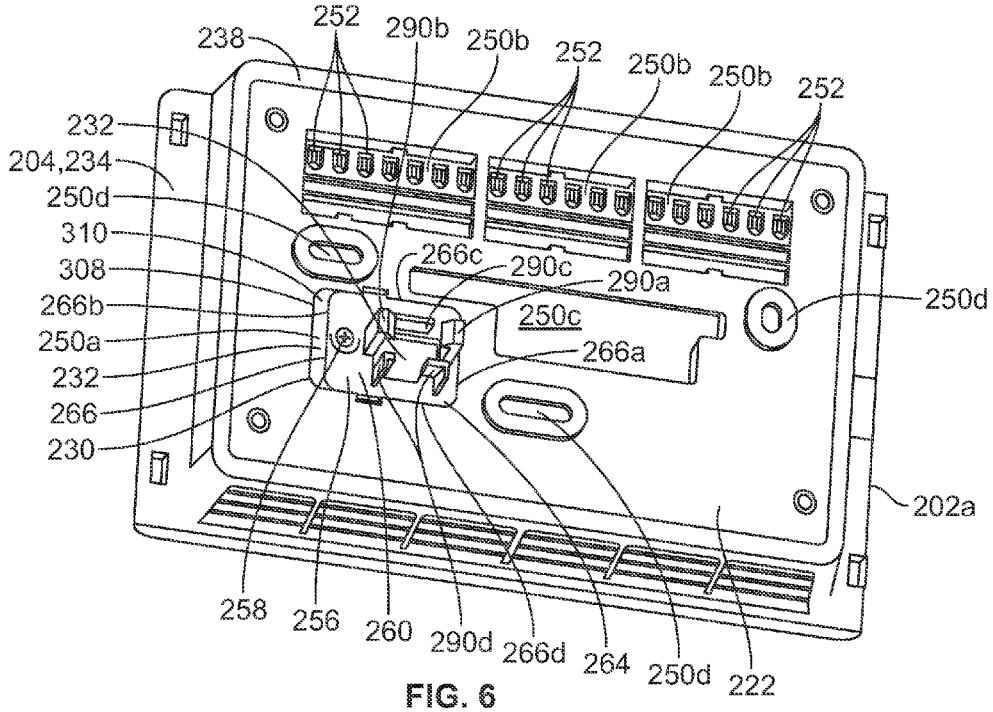
FIG. 6 illustrates a rear side view of a mounting plate coupled to an electronic thermostat according to an embodiment of the present invention.

FIG. 6 illustrates one example of an electronic thermostat 234 operably coupled to a mounting plate 202*a*. The mounting plate 202*a* shown in FIG. 6 includes a plurality of openings 250*a-d*. According to certain embodiments, at least a portion of the openings 250*b* are configured to accommodate or provide passageways for certain electronic features of the electronic thermostat 234, such as, for example, one or more electronic pins 252 and associated projections, while other openings 250*c* are adapted to reduce the material used to construct the mounting plate 202 and/or to receive or provide mating edges for a variety of extensions or projections that extend from the rear side of the electronic thermostat 234. Additionally, one or more of the openings 250*d* may provide passageways for the receipt of one or more fasteners 228 that secure the mounting plate 202 to the mounting structure 224. Additionally, as discussed below in more detail, according to certain embodiments, the mounting plate 202 may include at least one opening 250*a* that is configured to receive a retention member 256. Although FIG. 6 illustrates a mounting plate 202*a* that has a plurality of openings 250*a-d* that may have a variety of different purposes, as indicated by at least FIG. 5, the number, size, and type of openings 250*a-d* utilized by different embodiments of the mounting plate 202 may vary. For example, FIG. 5 depicts and embodiment in which the mounting plate 202 includes an opening 250*a* that is sized for the slideable displacement of the retention member 256. However, other embodiments of the mounting plate 202 may include one or more of the openings 250*b-d* that are illustrated in the embodiment of the mounting plate 202*a* that is shown in FIG. 6, such as, for example, openings 250*d* that are adapted to receive insertion of the fasteners 228, among other openings.

As shown in at least FIGS. 4-6, the mounting plate 202 may include at least one retention member 256 that is adapted to retain the plug 212 in a relatively static position relative to at least the mounting plate 202 when the mounting plate 202 is operably secured to the mounting structure 224. Further, as discussed below, according to certain embodiments, the retention member 256 may also be adapted to at least assist prevent the locking clip 214 of the plug 212 from engaging the protrusion of the jack 206. The retention member 256 may be formed as part of the mounting plate 202, or may be a separate component that is operably secured to the mounting plate 202. For example, referencing FIG. 6, according to certain embodiments, the retention member 256 may be secured to the mounting plate 202 via one or more mechanical fasteners 258, such as, for example, by a screw, bolt, or pin, among other fasteners. Alternatively, as discussed below, the retention member 256 may be slidingly displaced into a snap, press, or other form of locking engagement with the mounting plate 202.

Referencing FIGS. 7-10, the retention member 256 has a body segment 260 having a front portion 262, a rear portion 264, and an outer edge 266. Additionally, according to the illustrated embodiment, the outer edge 266 may include generally parallel first and second side edges 266*a*, 266*b* that are positioned on opposing sides of the retention member 256 and which are generally perpendicular to opposing upper and lower edges 266*c*, 266*d*. Additionally, an inner passageway 232 of the retention member 256 may generally extend between the front and rear portions 262, 264 of the retention member 256, and is sized to receive the insertion of at least a portion of the plug 212.

Figure 8:
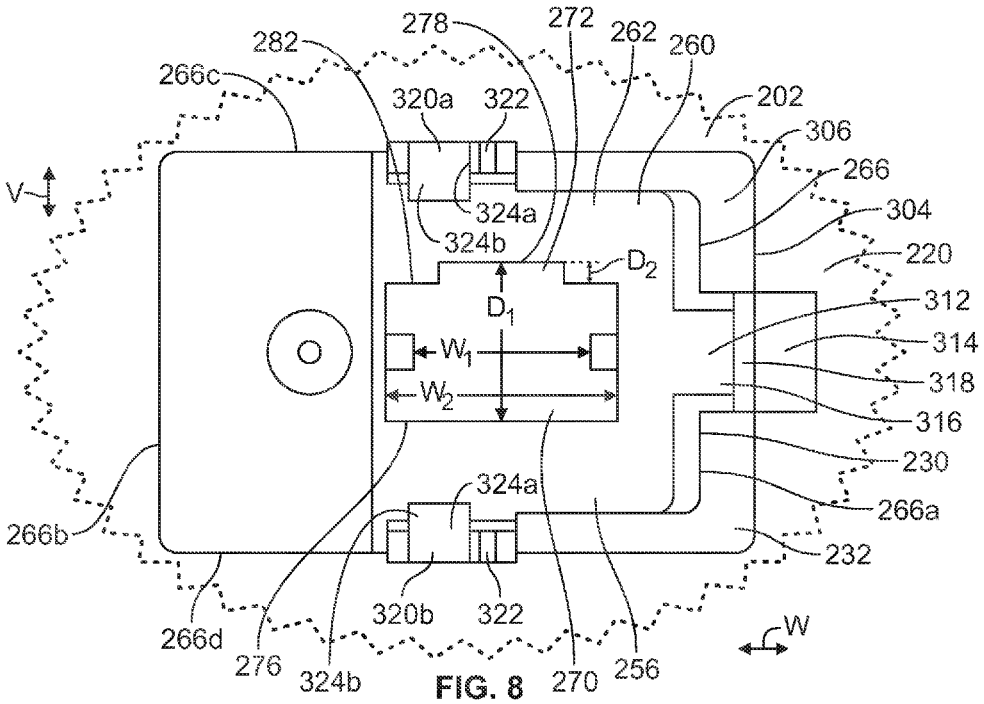
FIG. 8 illustrates a front side view of the retention member shown in FIG. 7 at the first, unlocked position relative to the mounting plate.
Figure 10:
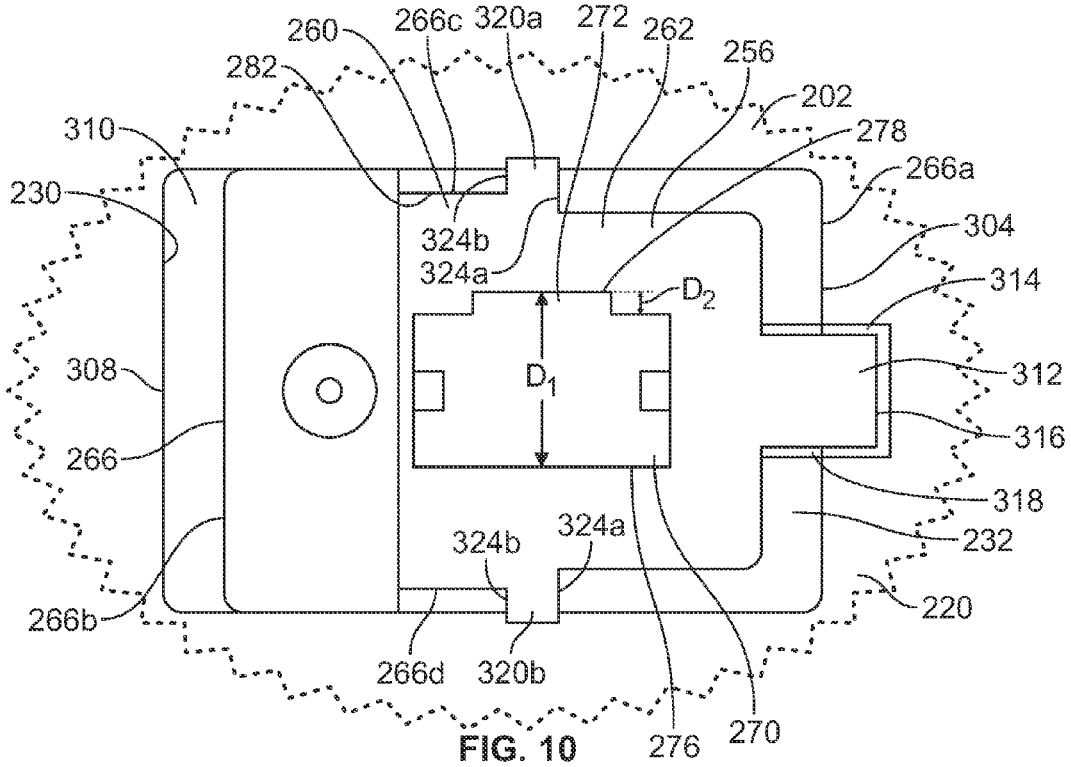
FIG. 10 illustrates a front side view of the retention member shown in FIG. 9 at the second, locked position relative to the mounting plate.

As shown in at least FIGS. 8 and 10, the inner passageway 232 may include a plug body region 270 and a locking clip region 272. According to certain embodiments, at least the locking clip region 272 of the inner passageway 232 may be sized or configured to depress the locking clip 214 of the plug 212, when the plug 212 is operably positioned in the inner passageway 232, to a position that prevents the locking clip 214 from lockingly engaging the protrusion 216 of the jack 206. For example, according to certain embodiments, opposing first sides 276, 278 of the plug body region 270 and the locking clip region 272, respectively, may be separated by a distance ("$D_1$" in FIGS. 8 and 10) such that the first sidewall 278 of the locking clip region 272 is positioned to at least partially compress or otherwise displace the locking clip 214 of the plug 212 at least toward the plug body 280 when the plug 212 is operably positioned within the inner passageway 232. Such compression or displacement of the locking clip 214 may be configured to prevent the locking clip 214 from lockingly engaging the mating protrusion 216 in the aperture 218 of the jack 206. Similarly, for example, according to certain embodiments, the first sidewall 278 of the locking clip region 272 and a second sidewall 282 of the plug body region 270 of the inner passageway 232 may be separated by a distance ("$D_2$" in FIGS. 8 and 10) such that the first sidewall 278 of the locking clip region 272 is positioned to depress the locking clip 214 of the plug 212 to a position that prevents the locking clip 214 from lockingly engaging the protrusion 216 of the jack 206.

Figure 3:
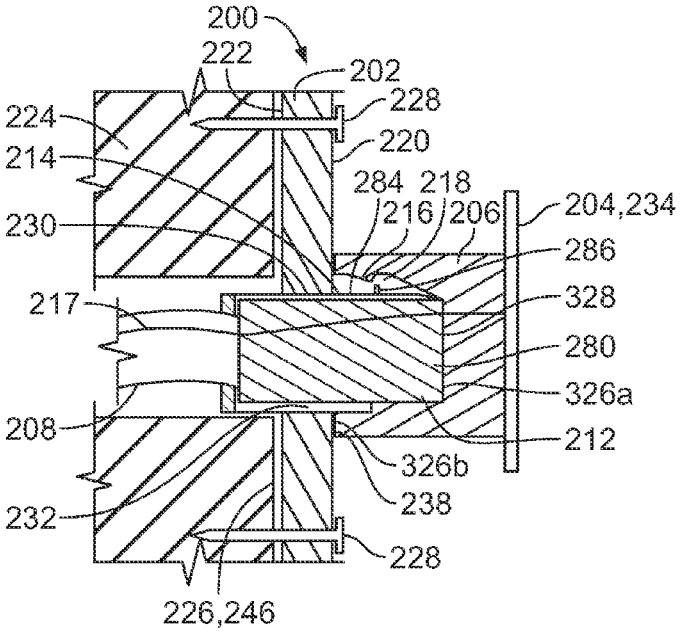
FIG. 3 illustrates a cross sectional side view of a wall-mounted assembly according to an embodiment of the present invention.

For example, as shown in FIG. 3, according to certain embodiments, the inner passageway 232 is configured such that the first sidewall 278 of the locking clip region 272 of the inner passageway 232 engages the arm portion 284 of the locking clip 214 so as to depress or displace the locking clip 214 from the first, rest position, to or toward the second depressed position. Moreover, as shown in FIG. 3, the first sidewall 278 of the locking clip region 272 is adapted to depress the arm portion 284 of the locking clip 214 toward an adjacent portion of the plug body 280 to a position in which the tab portion 286 does not engage the mating protrusion 216 in the aperture 218 of the jack 206 in a manner that would lockingly couple the locking clip 214 to the protrusion 216. Moreover, in the embodiment shown in FIG. 3, the first sidewall 278 of the locking clip region 272 is illustrated as depressing the arm portion 284 of the locking clip 214 to a location in which the tab portion 286 is below, and not in contact with, the protrusion 216 in the aperture 218 of the jack 206 when the plug 212 is operably positioned within the jack 206. However, according to other embodiments, the engagement between the first sidewall 278 of the locking clip region 272 may displace the tab portion 286 to a position in which a portion of the tab portion 286 contacts the protrusion 216 in the aperture 218 of the jack 206 in a manner that does not create a locking engagement between the locking clip 214 and the protrusion 216.

Figure 7:
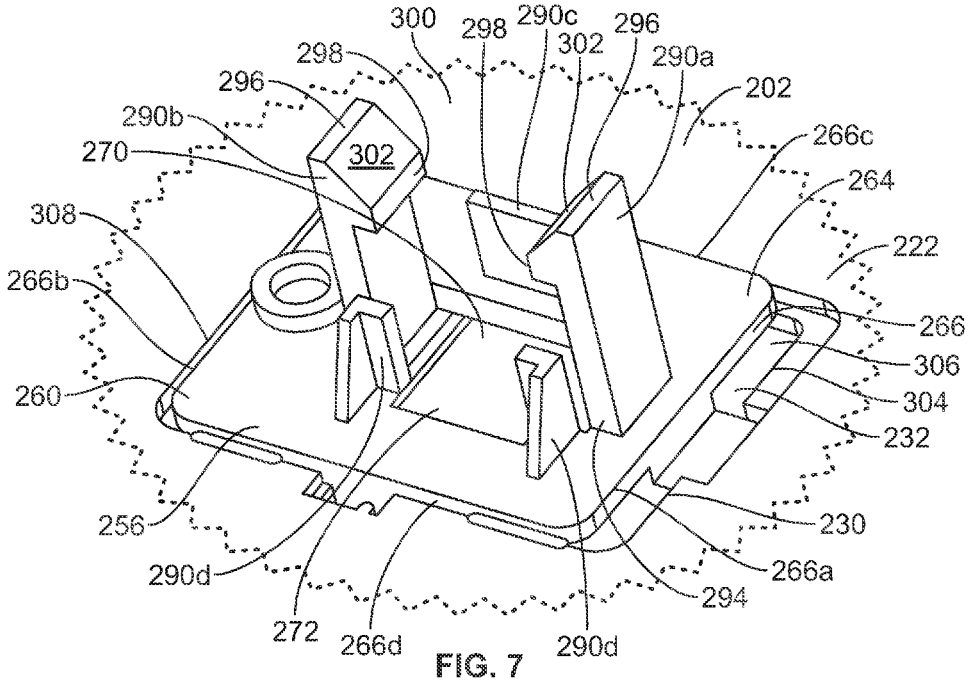
FIG. 7 illustrates a right rear side perspective view of a retention member at a first, unlocked position relative to a mounting plate according to an embodiment of the present invention.
Figure 9:
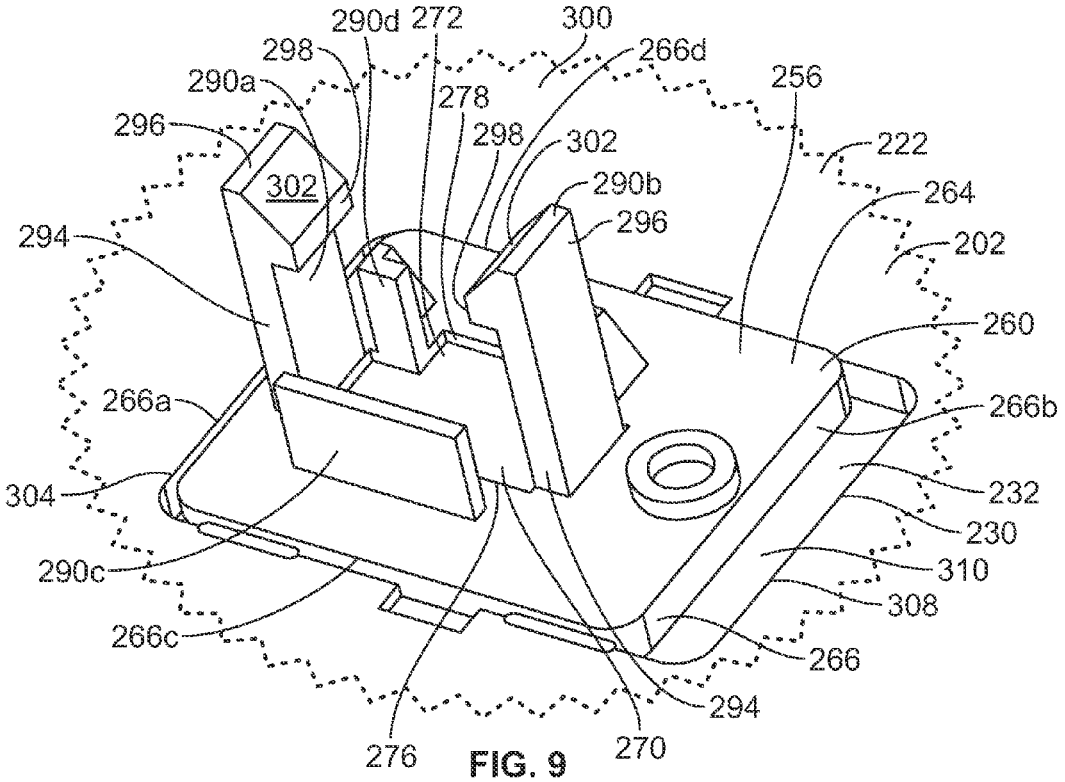
FIG. 9 illustrates a left rear side perspective view of the retention member shown in FIG. 7 with the retention member at a second, locked position relative to the mounting plate.

As shown in at least FIGS. 7 and 9, the retention member 256 may also include one or more arms or extensions 290 that extend outwardly from the rear portion 264 of the retention member 256. At least one or more of the arms 290 may be configured to retain the plug 212 in a generally static mounting position relative to at least the retention member 256. Moreover, one or more of the arms 290 may be configured to secure the plug 212 relative to the retention member 256 and/or the mounting plate 202 in a manner that allows the plug 212 to be retained in a mounting position when that plug 212 is both received in the aperture 218 of the jack 206 as the electronic device 204 is operably secured to the mounting plate 202, and remain in the mounting position as the plug 212 is removed from the aperture 218 of the jack 206. Additionally, such retention of the plug 212 in the mounting position also at least assist in retaining the plug 212 in operable position relative to the jack 206 when the electronic device 204 remains attached to the mounting plate 202. Further, while the at least one arms 290 are being discussed as protruding from the retention member 256, according to other embodiments that do not include the retention member, the at least one arm 290 may extend from the second side 222 of the mounting plate 202.

Figure 11:
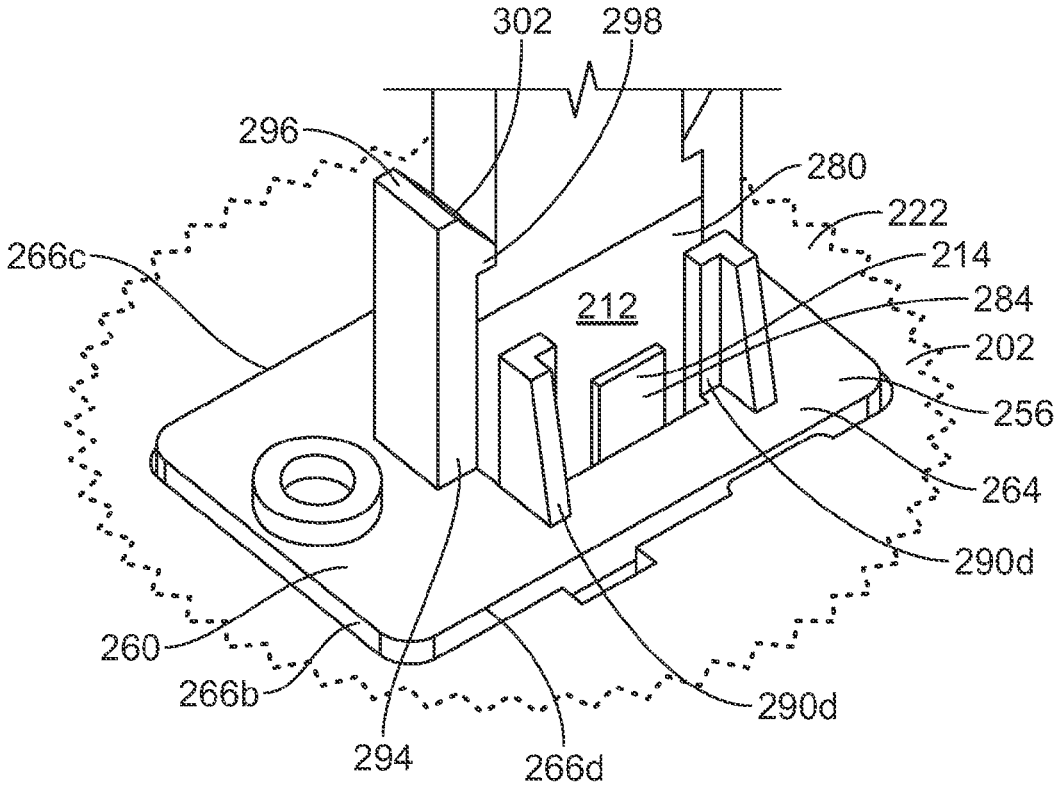
FIG. 11 illustrates a rear side perspective view of the retention member shown in FIG. 7 with the plug of the cable operably secured in position by the retention member according to an embodiment of the present invention.
Figure 12:
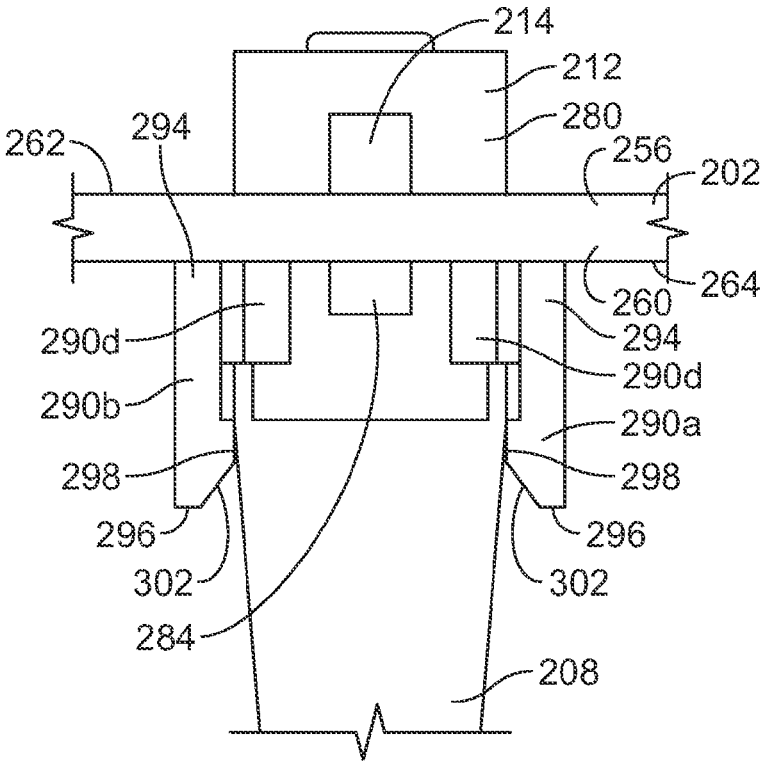
FIG. 12 illustrates a top view of the engagement shown in FIG. 11 between the retention member and the plug of the cable.

According to the illustrated embodiment, the arms 290 include opposing first and second side arms 290*a*, 290*b*. As shown in at least FIGS. 11 and 12, the first and second side arms 290*a*, 290*b* are adapted to engage opposing sidewalk 292*a*, 292*b* of the plug 212 and/or the cable 208. The first and second side arms 290*a*, 290*b* may each include a proximate end 294 and a distal end 296. The proximate end 294 may be operably coupled to the rear portion 264 of the retention member 256 or the second side 222 of the mounting plate 202 in proximity to the inner passageway 232. According to the illustrated embodiments, the distal end 296 of each of the first and second side arms 290*a*, 290*b* may both include a retention tab 298 that extends inwardly toward the other, opposing first and second side arm 290*a*, 290*b* in a manner that allows both retention tabs 298 to extend into an area or region over or preceding the inner passageway 232. For example, as shown in at least FIG. 7, the retention tab 298 of the first side arm 290*a* extends inwardly toward the second side arm 290*b*, and, more specifically, toward the retention tab 298 of the second side arm 290*b*. Additionally, the width (as indicated by "$W_1$" in FIG. 8) of a channel 300 between the retention tabs 298 of the first and second side arms 290*a*, 290*b* is less than the width (as indicated by "$W_2$" in FIG. 8) of the corresponding portion of the inner passageway 232. Such sizing of the retention tabs 298 may cause the first and second side arms 290*a*, 290*b* to be bent, deflected, and/or deformed from each other when the plug 212 is inserted into the inner passageway 232, as shown for example, in FIGS. 11 and 12. Moreover, such bending, deflection, and/or deforming of the first and second side arms 290*a*, 290*b* may cause the first and second side arms 290*a*, 290*b*, and more specifically, the retention tabs 298, to exert compressive forces against an adjacent region of the plug 212 and/or cable 208. Such compressive forces provided by the retention tabs 298, such as, for example, compressive forces against a rear portion of the plug 212, may at least assist in retaining the plug 212 and/or cable 208 in a relatively static position relative to the retention member 256 and/or mounting plate 202, and thus at least assist in preventing the plug 212 from being detached from the retention member 256 and/or mounting plate 202.

Additionally, according to certain embodiments, the retention tabs 298 may include an outer tapered or inclined surface 302 that is adapted to at least assist in guiding the passage of the plug 212 into the inner passageway 232 and/or to at least assist in the bending, deflection, and/or deformation of the first and second side arms 290*a*, 290*b*. Further, when the plug 212 and/or cable 208 are to be disengaged from the first and second side arms 290*a*, 290*b*, the first and second side arms 290*a*, 290*b* may be pried other otherwise displace so as to increase the size of the channel 300 between the retention tabs 298, and thereby decrease or release the associated compressive forces there the retention tabs 298 were exerting against the plug 212 or cable 208.

As shown in at least FIGS. 7 and 9, one or more upper arms 290*c* and lower arms 290*d* may extend from the rear portion 264 of the retention member 256 or second side 222 of the mounting plate 202. The upper and lower arms 290*c*, 290*d* may be positioned on opposing sides of the inner passageway 232 such that the upper and lower arms 290*c*, 290*d* engage or are otherwise adjacent to portions of the plug 212 and/or cable 208 that are generally perpendicular to portions of the plug 212 and/or cable 208 that are engaged by the first and second side arms 290*a*, 290*b*. The upper and lower arms 290*c*, 290*d* may be configured to provide support to the plug 212 and/or cable 208 and/or to prohibit movement of the plug 212 and/or cable 208 in a generally vertical direction (as indicated by "V" in FIG. 8). As shown in at least FIGS. 7 and 9, according to depicted embodiments, a pair of lower arms 290*d* may be position on opposing sides of the locking clip region 272 of the inner passageway 232, while a single upper end 272 may extend along at least a portion of an adjacent area of the plug body region 270 of the inner passageway 232. Additionally, demonstrated by FIG. 2, according to certain embodiments, one or more of the arms 290*a-d* may be adapted to extend into an opening 288 of the mounting structure 224 when the mounting plate 202 is operably mounted to the mounting structure 224.

According to certain embodiments, the mounting plate 202 may include an opening 268 that is sized for the slideable displacement of the retention member 256 from a first, unlocked position, as shown in at least FIGS. 7 and 8, to a second, locked position, as shown in at least FIGS. 9 and 10. For example, according to certain embodiments, the opening 268 may have a width (as indicated in the "W" direction in FIG. 8) between opposing first and second side edges 304, 308 that is wider than a corresponding width of the retention member 256 between opposing first and second side edges 266*a*, 266*b*. Thus, when the retention member 256 is in the first, unlocked position, a first side edge 266*a* of the retention member 256 may be separated from a corresponding first side edge 304 of the opening 268 by a first gap 306. Further, when the retention member 256 is the first, unlocked position, the second side edge 266*b* of the retention member 256 may be in relatively close proximity to, and/or abut against, an adjacent second side edge 308 of the opening 268. Conversely, when the retention member 256 is displaced from the first, unlocked position to the second, locked position, the first side edge 266*a* of the retention member 256 may be in relatively close proximity to, and/or abut against, the adjacent first side edge 304 of the opening 268, thereby reducing the size and/or eliminating the first gap 306. Further, when the retention member 256 in the second, locked position, the second side edge 266*b* of the retention member 256 may be separated or displaced away from the second side edge 308 of the opening 268 by a second gap 310 that has a width that is greater than the distance, if any, that the second side edge 266*b* of the retention member 256 was separated from the second side edge 308 of the opening 268 when the retention member 256 was in the first, unlocked position.

The retention member 256 may also include one or more locking tabs 312 that are configured to retain the retention member 256 in the second, locked position. For example, according to the embodiment shown in at least FIGS. 8 and 10, a locking tab 312 that extends from the first side edge 266*a* of the retention member 256 may be configured to lockingly engage at least a retention recess 314 in the first side 220 of the mounting plate 202 when the retention member 256 is in the second, locked position. According to certain embodiments, as the retention member 256 is displaced from the first, unlocked position and toward the second, locked position, at least a front portion 316 of the locking tab 312 may abut against an abutment area 318 of the mounting plate 202. According to certain embodiments, the abutment area 318 may provide an interference or barrier against the locking tab 312 from being displaced to a position in which the locking tab 312 may lockingly engage the retention recess 314. Thus, according to certain embodiments, in order for the retention member 256 to reach the second position, at least a portion of the retention member 256 and/or abutment area 318 may be subjected to a force sufficient to overcome the interference or barrier provided by the abutment area 318. For example, according to certain embodiments, the retention member 256 may be subjected to a force that is sufficient to bend, deflect, and/or deform the locking tab 312 and/or the abutment area 318 in a manner that allows the locking tab 312 to be displaced relative to the abutment area 318 to a position in which at least a portion of the locking tab 312 is lockingly received within the retention recess 314. Similarly, if the retention member 256 is to be displaced from the second, locked position to the first, unlocked position, the retention member 256 may be subjected to a force that is sufficient to bend, deflect, and/or deform the locking tab 312 and/or the abutment area 318 in a manner that allows the locking tab 312 to be displaced away and/or released from the retention recess 314.

Additionally, according to the illustrated embodiment, the retention member 256 may also include upper and lower retention tabs 320*a*, 320*b* that extend from the upper and lower edges 266*c*, 266*d*, respectively, of the retention member 256. According to certain embodiments, when in the second, locked position, the upper and lower retention tabs 320*a*, 320*b* engage abutments 322 of the mounting plate 202 in a manner that provides a friction or press fit between the upper and lower retention tabs 320*a*, 320*b* and the abutments 322. Alternatively, according to other embodiments, the abutments 322 may provide interference or barriers that resist the displacement of the upper and lower retention tabs 320*a*, 320*b* past the abutments 322. Accordingly, when the retention member 256 is in the first, unlocked position, as shown for example, in FIG. 8, the abutments 322 may be located adjacent to a first side 324*a* of the upper and lower retention tabs 320*a*, 320*b* to provide barriers that resist the displacement of the upper and lower retention tabs 320*a*, 320*b*, and thereby resist displacement of the retention member 256, to the second, locked position. When the retention member 256 is to be displaced to the second, locked position, the retention member 256 may be subjected to a displacement force that is sufficient to cause the upper and lower retention tabs 320*a*, 320*b* and/or the abutments 322 to bend, deflected, and/or deform in a manner that facilitates the displacement of the upper and lower retention tabs 320*a*, 320*b* past, or into operable engagement with, the corresponding abutment 322. According to certain embodiments, with the upper and lower retention tabs 320*a*, 320*b* in the second, locked position, the abutments 322 may be positioned adjacent to a second side 324*b* of the upper and lower retention tabs 320*a*, 320*b*. According to certain embodiments, subsequent displacement of the upper and lower retention tabs 320*a*, 320*b* from the second, locked position to the first, unlocked position may again utilize a force similar to the force applied to the retention member 256 (but in an opposing direction) that may again result in the upper and lower retention tabs 320*a*, 320*b* and/or abutments 322 being bent, deflected, and/or deformed in a manner that facilitates the displacement of the upper and lower retention tabs 320*a*, 320*b* past, or out of operable engagement with, the abutments 322. Alternatively, rather than securely engaging the abutments 322, the upper and lower tabs 320*a*, 320*b* may be lockingly engaged within apertures or recesses in the mounting plate 202.

FIG. 2 illustrates an embodiment of the present invention in which the first and second side arms 290*a*, 290*b* of the retention member 256 are adapted to retain a rear portion 264 the plug 212 away from the aperture 218 of the jack 206 at a distance that prevents the locking clip 214 of the plug 212 from entering into the aperture 218, thereby precluding the locking clip 214 from becoming lockingly engaged with the jack 206. Further, according to certain embodiments, the distance between front and rear portions 326*a*, 326*b* of the aperture 218 may provide the aperture 218 with a depth that is less than the distance between a face portion 328 of the plug 212 and the tab portion 286 of the locking clip 214. Thus, according to the embodiment shown in FIG. 2, when the plug 212 is operably positioned in the aperture 218 so that the contacts of the plug 212 are in electrical communication with the leads of the jack 206, the tab portion 286 of the locking clip 214 is outside of the aperture 218. According to such embodiments, as the tab portion 286 does not, and cannot, enter into the aperture 218 of the jack 206, the jack 206 may be configured to not include the mating protrusion 128. As a result, the electronic device 204 can be easily disengaged from the plug 212 and/or cable 208 when the electronic device 204 is displaced away from the mounting plate 202.

Embodiments disclosed herein allow a user to remove and reattach the electronic device 204 to the mounting plate 202 without the user having to remember to actuate the locking clip 214. Further, such embodiments also prevent unintentional damage that can occur from pulling the electronic device 204 from the mounting plate 202 without realizing the plug 212 is operably engaged with the aperture 218 of the jack 206. Further, as the cable 208 is held in place by the mounting plate 202, the cable 208 may remain concealed from view within the mounting structure 224, and associated wire routing may be positioned completely within the mounting structure 224 and or behind the mounting surface 226. Thus, installation and removal of the wall-mounted assembly 200 in which the electronic device 204 is an electronic thermostat 234 may generally mimic traditional thermostats while maintaining an operable connection between the plug 212 and the jack 206.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A mounting plate for securing a plug of a network cable to a jack of an electronic device, the mounting plate comprising:

an inner wall that generally defines an inner passageway, the inner passageway configured to receive placement of at least a portion of the plug of the network cable, the inner wall being configured to engage a locking clip of the plug when the plug is operably positioned in the inner passageway to displace the locking clip to a position that prevents the locking clip from lockingly engaging a mating protrusion in an aperture of the jack.

2. The mounting plate of claim 1, further including at least one arm that is configured to retain the plug in a relatively static position relative to the mounting plate when the plug is being received in, and removed from, an aperture of the jack.

3. The mounting plate of claim 2, wherein the inner passageway has a plug body region and a locking clip region, at least a portion of the inner wall along the locking clip region being positioned to displace the locking clip to prevent a tab portion of the locking clip from lockingly engaging the mating protrusion in the aperture of the jack.

4. The mounting plate of claim 3, wherein the mounting plate includes an attachment mechanism configured for the removable attachment of the electronic device to the mounting plate.

5. The mounting plate of claim 4, wherein the attachment mechanism includes one or more protrusions that are adapted to lockingly engage one or more orifices of the electronic device.

6. The mounting plate of claim 5, wherein the at least one arm includes a first side arm and a second side arm, the first and second side arms being positioned on opposing sides of the inner passageway, the first and second side arms adapted to exert a compressive force on an adjacent portion of the plug to retain the plug in the relatively static position relative to the mounting plate when the plug is operably positioned in the inner passageway.

7. The mounting plate of claim 6, wherein the first and second side arms each include a retention tab, the retention tab of the first side arm being separated from the retention tab of the second side arm by a width that is smaller than a corresponding width of the plug body region of the inner passageway.

8. The mounting plate of claim 7, wherein the at least one arm further includes an upper arm and at least one lower arm, the upper arm and the at least one lower arm being positioned on opposing sides of the inner passageway and generally perpendicular to the first and second side arms.

9. The mounting plate of claim 8, wherein the mounting plate further includes a retention member that is slideable from a first, unlocked position to a second, locked position along an opening of the mounting plate, wherein the inner passageway is positioned within a body segment of the retention member and the at least one arm that protrudes from a rear portion of the retention member.

10. A mounting plate assembly for securing a plug of a network cable to a jack of an electronic device, the mounting plate assembly comprising:

a mounting plate including an attachment mechanism configured for releasable locking engagement with the electronic device, the mounting plate further adapted to be mounted to a mounting structure by one or more fasteners; and a retention member adapted for slideable displacement from a first, unlocked position to a second, locked position in an opening of the mounting plate, the retention member having an inner wall that extends between a front portion and a rear portion of the mounting plate, the inner wall defining an inner passageway that is adapted to receive insertion of at least a portion of the plug, the inner wall further adapted to depress a locking clip of the inserted plug to a position that prevents the locking clip from lockingly engaging a mating protrusion in an aperture of the jack, the retention member further including at least one arm that protrudes from the rear portion, the at least one arm configured to retain the plug in a relatively static position relative to the retention member when the plug is being received in, and removed from, the aperture of the jack.

11. The mounting plate assembly of claim 10, wherein the at least one arm includes a first side arm and a second side arm, the first and second side arms being positioned on opposing sides of the inner passageway, the first and second side arms adapted to exert a compressive force on an adjacent portion of the plug to retain the plug in the relatively static position relative to the mounting plate when the plug is operably positioned in the inner passageway.

12. The mounting plate assembly of claim 11, wherein the retention member further includes a locking tab that is adapted to lockingly engage a retention recess of the mounting plate to retain the retention member in the second, locked position.

13. The mounting plate assembly of claim 12, wherein the retention member further includes at least one of an upper retention tab and a lower retention tab, the upper and lower retention tabs extending from the retention member in directions that are generally perpendicular to the locking tab, the upper and lower retention tabs configured to lockingly engage an abutment area of the mounting plate when the retention member is in the second, locked position.

14. The mounting plate assembly of claim 13, wherein the attachment mechanism includes one or more protrusions that lockingly engage one or more orifices of the electronic device.

15. A wall-mounted assembly that interfaces with a plug of a network cable, the wall-mounted assembly comprising:

an electronic device having a jack, the jack having an aperture adapted to receive insertion of at least a portion of the plug, the aperture including a protrusion configured to lockingly engage a locking clip of the plug;

a mounting plate adapted to be attached to a wall by one or more fasteners, the mounting plate having an inner passageway that is size to receive placement of at least a portion of the plug of the network cable, the inner passageway further configured to displace the locking clip to a depressed position to prevent the locking clip from lockingly engaging the protrusion of the jack when the plug is operably positioned within the aperture, the mounting plate further including at least one arm that is configured to retain the plug in a relatively static position relative to the mounting plate when the plug is being received in, and removed from, the aperture of the jack.

16. The wall-mounting assembly of claim 15, wherein the at least one arm includes a first side arm and a second side arm, the first and second side arms being position on opposing sides of the inner passageway, the first and second side arms adapted to exert a compressive force on an adjacent portion of the plug to retain the plug in the relatively static position relative to the mounting plate when the plug is operably positioned in the inner passageway.

17. The wall-mounting assembly of claim 16, wherein the mounting plate includes an attachment mechanism for a releasable lockingly engagement between the mounting plate and the electronic device.

18. The wall-mounted assembly of claim 17, wherein the electronic device is an electronic thermostat that is adapted to control operations of an HVAC system.

19. The wall-mounting assembly of claim 18, wherein the mounting plate further includes a retention member, the retention member being displaceable between a first, unlocked position and a second, locked position within an opening of the mounting plate, the inner passageway extending between a front portion and a rear portion of the retention member, and wherein the at least one arm extends from the rear portion of the retention member.

20. The wall-mounting assembly of claim 19, wherein the retention member further includes a locking tab that is adapted to lockingly engage a retention recess of the mounting plate to at least assist in retaining the retention member in the second, locked position.

21. The wall-mounting assembly of claim 20, wherein the first and second side arms each include a retention tab, the retention tab of the first side arm being separated from the retention tab of the second side arm by a width that is smaller than a corresponding width of a plug body region of the inner passageway.

* * * * *